US009745702B2

(12) United States Patent
Stage et al.

(10) Patent No.: US 9,745,702 B2
(45) Date of Patent: Aug. 29, 2017

(54) HIGH BULK TISSUE SHEETS AND PRODUCTS

(71) Applicant: Kimberly-Clark Worldwide, Inc., Neenah, WI (US)

(72) Inventors: Douglas Wayne Stage, Appleton, WI (US); Jennifer Leigh Jeschke, Oshkosh, WI (US); Richard Joseph Behm, Appleton, WI (US); Donald John Slayton, Appleton, WI (US); Jeffrey Dean Holz, Sherwood, WI (US); Mark William Sachs, Appleton, WI (US); Kevin Joseph Vogt, Neenah, WI (US); Mark Alan Burazin, Oshkosh, WI (US); Lynda Ellen Collins, Neenah, WI (US); Richard Allen Zanon, Appleton, WI (US); Joseph Walter Buyeske, Oshkosh, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 287 days.

(21) Appl. No.: 14/571,900

(22) Filed: Dec. 16, 2014

(65) Prior Publication Data

US 2015/0101774 A1 Apr. 16, 2015

Related U.S. Application Data

(63) Continuation of application No. 13/747,816, filed on Jan. 23, 2013, now Pat. No. 8,940,376.

(60) Provisional application No. 61/595,937, filed on Feb. 7, 2012.

(51) Int. Cl.

| | |
|---|---|
| ***D21F 11/14*** | (2006.01) |
| ***D21H 27/30*** | (2006.01) |
| ***D21H 27/00*** | (2006.01) |
| *A47K 10/16* | (2006.01) |

(52) U.S. Cl.

CPC ..... *D21H 27/005* (2013.01); *D21H 1/00* (2013.01); *D21H 27/002* (2013.01); *A47K 10/16* (2013.01); *Y10T 428/1303* (2015.01); *Y10T 428/1348* (2015.01); *Y10T 428/1352* (2015.01); *Y10T 428/24355* (2015.01); *Y10T 428/31993* (2015.04)

(58) Field of Classification Search

CPC .... B65H 19/2276; B65H 18/10; B65H 18/22; Y10T 428/24455

USPC ..... 242/160.1, 532.2; 428/35.7, 34.1, 35.6

See application file for complete search history.

(56) References Cited

U.S. PATENT DOCUMENTS

| | | | |
|---|---|---|---|
| 5,672,248 | A | 9/1997 | Wendt et al. |
| 5,904,811 | A | 5/1999 | Ampulski et al. |
| 6,077,590 | A | 6/2000 | Archer et al. |
| 6,423,180 | B1 | 7/2002 | Behnke et al. |
| 6,887,348 | B2 | 5/2005 | Hermans et al. |
| 7,294,229 | B2 | 11/2007 | Hada et al. |
| 7,419,569 | B2 | 9/2008 | Hermans et al. |
| 7,470,345 | B2 | 12/2008 | Troxell et al. |
| 7,611,605 | B2 | 11/2009 | Burazin et al. |
| 7,726,349 | B2 | 6/2010 | Mullally et al. |

(Continued)

*Primary Examiner* — Ellen S Wood

(74) *Attorney, Agent, or Firm* — Kimberly-Clark Worldwide, Inc.

(57) ABSTRACT

Spirally wound paper products are disclosed having desirable roll bulk, firmness and softness properties. The rolled products can be made from single ply tissue webs formed according to various processes.

12 Claims, 3 Drawing Sheets

(56) References Cited

U.S. PATENT DOCUMENTS

| | | | |
|---|---|---|---|
| 7,935,221 | B2 | 5/2011 | Allen et al. |
| 7,938,932 | B2 | 5/2011 | Hermans et al. |
| 8,481,133 | B2 | 7/2013 | Hermans et al. |
| 8,500,955 | B2 | 8/2013 | Hermans et al. |
| 2004/0200590 | A1 | 10/2004 | Wilhelm |
| 2007/0131366 | A1 | 6/2007 | Underhill et al. |
| 2009/0242154 | A1 | 10/2009 | Beuther et al. |
| 2010/0051217 | A1 | 3/2010 | Allen et al. |
| 2011/0079671 | A1 | 4/2011 | Wojcik et al. |
| 2013/0071678 | A1 | 3/2013 | Shannon |
| 2013/0299623 | A1 | 11/2013 | Dollevoet et al. |

HIGH BULK TISSUE SHEETS AND PRODUCTS

RELATED APPLICATIONS

The present application is a continuation application and claims priority to U.S. patent application Ser. No. 13/747,816, filed on Jan. 23, 2013, which claims priority to U.S. Provisional Application No. 61/595,937, filed Feb. 7, 2012, all of which are hereby incorporated by reference in a manner consistent with the present application.

BACKGROUND

For rolled tissue products, such as bathroom tissue and paper towels, consumers generally prefer firm rolls having a large diameter. A firm roll conveys superior product quality and a large diameter conveys sufficient material to provide value for the consumer. From the standpoint of the tissue manufacturer, however, providing a firm roll having a large diameter is a challenge. In order to provide a large diameter roll, while maintaining an acceptable cost of manufacture, the tissue manufacturer must produce a finished tissue roll having higher roll bulk. One means of increasing roll bulk is to wind the tissue roll loosely. Loosely wound rolls however, have low firmness and are easily deformed, which makes them unappealing to consumers. As such, there is a need for tissue rolls having high bulk as well as good firmness. Furthermore, it is desirable to provide a rolled tissue product having a tissue sheet with sufficient basis weight so as to provide greater absorbency and hand protection in use.

Although it is desirable to provide a sheet having sufficient basis weight, bulk and good roll firmness, improvement of one of these properties typically comes at the expense of another. For example, as the basis weight of the tissue sheets is increased, achieving high roll bulk becomes more challenging since increasing basis weight reduces the number of wraps of a spirally wound roll at the same roll weight.

Finally, in addition to the high roll bulk and good roll firmness, consumers also often prefer multi-ply tissue for the softness and absorbency characteristics inherent to multi-ply tissue structures. Hence the manufacturer producing singly-ply tissue webs faces the additional challenge of producing single ply webs that are comparable in softness and absorbency to multi-ply webs, while striving to economically produce a tissue roll that meets these often-contradictory parameters of large diameter, good firmness, high quality sheets and acceptable cost.

SUMMARY

The present inventors have now discovered that the often-contradictory parameters of large diameter, good firmness, high quality sheets and acceptable cost may be provided in a singly-ply tissue by forming a through-air-dried tissue using high topography fabrics in both the transfer and through-air drying positions. In this manner, the inventors have produced both basesheets and spirally wound tissue rolls having improved properties, such as increased sheet and roll bulk, reduced sheet stiffness and improved roll firmness.

Accordingly, in one embodiment the present disclosure provides a rolled tissue product comprising a single ply tissue web spirally wound into a roll, the single ply web having a bone dry basis weight from about 25 to about 35 grams per square meter (gsm) and a sheet bulk greater than about 15 cc/g and the wound roll having a Roll Firmness from about 5 to about 10 mm.

In another embodiment the present disclosure provides a single ply tissue web having a geometric mean tensile less than about 1000 g/3", a sheet bulk greater than about 15 cc/g and a Stiffness Index of less than about 8. Preferably the single ply tissue webs have a basis weight from about 25 to about 35 gsm, and a geometric mean tensile less than about 1200 g/3", such as from about 700 to about 1000 g/3".

In still other embodiments the present disclosure provides a calendered single ply tissue web having a bone dry basis weight from about 25 to about 35 gsm, a sheet bulk from about 16 to about 20 cc/g and a Stiffness Index from about 6 to about 8.

In yet other embodiments the present disclosure provides a rolled tissue product comprising a single ply tissue web spirally wound into a roll, the tissue web having a textured background surface and a design element, a geometric mean tensile less than about 1000 g/3", a sheet bulk greater than about 15 cc/g and a Stiffness Index less than about 8, wherein the wound roll has a roll bulk greater than about 10 cc/g.

DEFINITIONS

Figure 1:
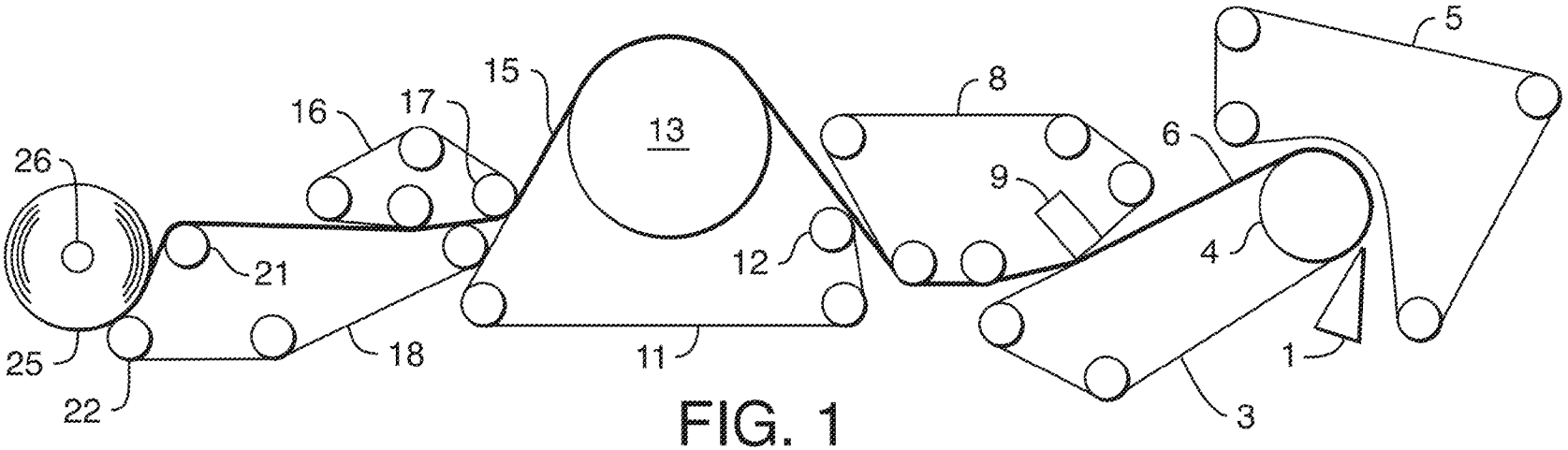
FIG. 1 is a schematic diagram of one embodiment of a process for forming an uncreped through-dried tissue web for use in the present disclosure.

As used herein, the term "tissue product" refers to products made from base webs comprising fibers and includes, bath tissues, facial tissues, paper towels, industrial wipers, food service wipers, napkins, medical pads, and other similar products.

As used herein, the terms "tissue web" or "tissue sheet" refer to a cellulosic web suitable for making or use as a facial tissue, bath tissue, paper towels, napkins, or the like. It can be layered or unlayered, creped or uncreped, and can consist of a single ply or multiple plies. The tissue webs referred to above are preferably made from natural cellulosic fiber sources such as hardwoods, softwoods, and nonwoody species, but can also contain significant amounts of recycled fibers, sized or chemically-modified fibers, or synthetic fibers.

As used herein, the term "roll bulk" refers to the volume of paper divided by its mass on the wound roll. roll bulk is calculated by multiplying pi (3.142) by the quantity obtained by calculating the difference of the roll diameter squared ($cm^2$) and the outer core diameter squared ($cm^2$) divided by 4, divided by the quantity sheet length (cm) multiplied by the sheet count multiplied by the bone dry basis weight of the sheet (gsm).

As used herein, the term "sheet caliper" is the representative thickness of a single sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester (Emveco, Inc., Newberg, Oreg.). The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second. Caliper may be expressed in mils (0.001 inches) or microns.

As used herein, the term "sheet bulk" refers to the quotient of the caliper (μm) divided by the bone dry basis weight (gsm). The resulting sheet bulk is expressed in cubic centimeters per gram (cc/g).

As used herein, the terms "tensile strength," "MD tensile," and "CD tensile," generally refer to the maximum stress that a material can withstand while being stretched or pulled in any given orientation as measured using a crosshead speed of 254 millimeters per minute, a full scale load of 4,540 grams, a jaw span (gauge length) of 50.8 millimeters and a specimen width of 762 millimeters. The MD tensile strength is the peak load per 3 inches of sample width when a sample is pulled to rupture in the machine direction. Similarly, the CD tensile strength represents the peak load per 3 inches of sample width when a sample is pulled to rupture in the cross-machine direction.

Samples for tensile strength testing are prepared by cutting a 3 inches (76.2 mm)×5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 2±0.04 inches (50.8±1 mm). The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile" or the "CD tensile" of the specimen depending on the sample being tested. At least five (5) representative specimens are tested for each product, taken "as is," and the arithmetic average of all individual specimen tests is either the MD or CD tensile strength for the product.

As used herein, the term "geometric mean tensile" (GMT) refers to the square root of the product of the machine direction tensile and the cross-machine direction tensile of the web, which are determined as described above.

As used herein, the term "slope" refers to the slope of the line resulting from plotting tensile versus stretch and is an output of the MTS TestWorks™ in the course of determining the tensile strength as described above. Slope is reported in the units of grams (g) per unit of sample width (inches) and is measured as the gradient of the least-squares line fitted to the load-corrected strain points falling between a specimen-generated force of 70 to 157 grams (0.687 to 1.540 N) divided by the specimen width.

As used herein, the term "geometric mean slope" (GM Slope) generally refers to the square root of the product of the machine direction slope and the cross-machine direction slope of the web, which are determined as described above.

As used herein, the term "Stiffness Index" refers to the quotient of the geometric mean slope divided by the geometric mean tensile strength.

$$\text{Stiffness Index} = \frac{\sqrt{MD\ \text{Tensile Slope} \times CD\ \text{Tensile Slope}}}{GMT}$$

As used herein, the term "Roll Firmness," generally refers to Kershaw Firmness, which is measured using the Kershaw Test as described in detail in U.S. Pat. No. 6,077,590, which is incorporated herein by reference in a manner consistent with the present disclosure. The apparatus is available from Kershaw Instrumentation, Inc. (Swedesboro, N.J.) and is known as a Model RDT-2002 Roll Density Tester.

As used herein, the term "Roll Structure," generally refers to the firmness and bulk of a rolled tissue product at a given sheet bulk and is the quotient of roll bulk (expressed in cc/g) divided by the Roll Firmness (expressed in cm), divided by single sheet caliper (express in cm).

DETAILED DESCRIPTION

In general, the present disclosure is directed towards single ply tissue webs and spirally wound tissue products produced therefrom, as well as methods of producing the same. The tissue webs are preferably formed by a through-air drying process and more preferably an uncreped through-air drying process ("UCTAD") that utilizes high topography papermaking fabrics for both the transfer and throughdrying fabrics. More preferably tissue webs produced according to the present disclosure have a pattern or design element disposed on at least one side. The design elements are preferably imparted by a pattern that has been disposed on a throughdrying fabric used in the manufacture of the tissue web.

The use of high topography fabrics in both the transfer and throughdrying positions yields both tissue webs and spirally wound products having a unique combination of properties that represent various improvements over prior art products. For instance, tissue webs may have increased bulk and reduced stiffness compared to prior art webs. Similarly, rolled products prepared according to the present disclosure may have improved roll firmness and bulk, while still maintaining sheet softness and strength properties.

For example, the present disclosure provides tissue webs having improved caliper and bulk compared to prior art webs, while also having decreased stiffness. These improvements translate into improved rolled products, as summarized in the table below.

TABLE 1

| Sample | Basis Weight (gsm) | Roll Firmness (mm) | Caliper (mils) | Roll Bulk (cc/g) | Stiffness Index |
|---|---|---|---|---|---|
| Invention | 29.8 | 9.0 | 21.8 | 13.1 | 7.23 |
| Invention | 33.7 | 10.2 | 21.7 | 13.0 | 6.83 |
| Charmin Basic | 32.4 | 11.5 | 13.0 | 11.0 | 9.38 |
| Cottonelle | 46.4 | 7.6 | 19.9 | 10.0 | 7.50 |
| Scott Extra Soft | 32.9 | 3.2 | 12.8 | 7.4 | 10.71 |

Accordingly, in certain embodiments, rolled products made according to the present disclosure may comprise a spirally wound single-ply tissue web having a basis weight greater than about 25 gsm, such as from about 28 to about 35 gsm and more preferably from about 30 to about 33 gsm.

Generally, when referred to herein, the basis weight is the bone dry basis weight in grams per square meter (gsm). Spirally wound rolled products preferably have a Roll Firmness of less than about 12 mm, such as from about 7 to about 12 mm and more preferably from about 8 to about 10 mm. In one particular embodiment, for instance, the disclosure provides a rolled tissue product comprising a spirally wound single ply tissue web having a basis weight from about 26 to about 34 gsm, wherein the roll has a Roll Firmness from about 8 to about 10 mm. Within the above-roll firmness ranges, rolls made according to the present disclosure do not appear to be overly soft and "mushy" as may be undesirable by some consumers during some applications.

In the past, at the above-roll firmness levels, spirally wound tissue products had a tendency to have low roll bulks and/or poor sheet softness properties. However, it has now been discovered that single ply webs having basis weights greater than about 25 gsm, preferably about 30 gsm or greater, such as from about 30 to about 35 gsm, can be produced such that when the webs are spirally wound into rolls, the resulting rolls have a roll bulk of at least about 12 cc/g, such as from about 12 to about 18 cc/g, and more preferably from about 12 to about 15 cc/g, even when spirally wound under tension. For instance, spirally wound products comprising a single ply web having a basis weight from about 28 to about 34 gsm may have a roll bulk of about 13 cc/g while still maintaining a Roll Firmness greater than about 8 mm, such as from about 9 to about 10 mm.

In still other embodiments, the present disclosure provides tissue webs having enhanced bulk, softness and durability. Improved durability includes, increased machine and cross machine direction stretch (MDS and CDS), while improved softness may be measured as a reduction in the slope of the tensile-strain curve. For example, tissue webs prepared according to the present disclosure may have a geometric mean tensile (GMT) greater than about 700 g/3", such as from about 750 to about 1,200 g/3", and more preferably from about 800 to about 1,000 g/3", while at the same time having a geometric mean slope of less than about 7,500 g/3", such as about 4,000 to about 7,000 g/3", and more preferably from about 5,000 to about 6,000 g/3".

While the tissue webs of the present disclosure generally have lower geometric mean slopes compared to webs of the prior art, the webs maintain a sufficient amount of tensile strength to remain useful to the consumer. For example, in certain instances, the disclosure provides single ply tissue webs having a geometric mean slope less than about 7,500 g/3", such as from about 4,000 to about 6,500 g/3", and a GMT less than about 1,200 g/3" and more preferably less than about 1,100 g/3", such as from about 700 to about 1000 g/3". Accordingly, tissue webs of the present invention preferably have a Stiffness Index less than about 10, still more preferably less than about 9, such as from about 4 to about 8, and more preferably from about 5 to about 7.

Tissue webs that are converted to finished product by calendering generally have increased stiffness relative to the basesheet, thus in certain embodiments basesheets prepared according to the present invention may have a Stiffness Index less than about 7, such as from about 4 to about 7, while the corresponding finished product may have a Stiffness Index less than about 9, such as from about 6 to about 8. As such the webs are not only soft, but are also strong enough to withstand use.

In other embodiments tissue webs prepared according to the present disclosure may have a cross-machine direction stretch (CDS) of at least about 8 percent, such as from about 10 to about 15 percent and more preferably from about 10 to about 12 percent.

Webs useful in preparing spirally wound tissue products according to the present disclosure can vary depending upon the particular application. In general, the webs can be made from any suitable type of fiber. For instance, the base web can be made from pulp fibers, other natural fibers, synthetic fibers, and the like. Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish.

Tissue webs made in accordance with the present disclosure can be made with a homogeneous fiber furnish or can be formed from a stratified fiber furnish producing layers within the single-ply product. Stratified base webs can be formed using equipment known in the art, such as a multi-layered headbox.

For instance, different fiber furnishes can be used in each layer in order to create a layer with the desired characteristics. For example, layers containing softwood fibers have higher tensile strengths than layers containing hardwood fibers. Hardwood fibers, on the other hand, can increase the softness of the web. In one embodiment, the single ply base web of the present disclosure includes at least one layer containing primarily hardwood fibers. The hardwood fibers can be mixed, if desired, with softwood and/or broke fibers in an amount up to about 40 percent by weight and more preferably from about 15 to about 25 percent by weight. The base web further includes a middle layer positioned in between the first outer layer and the second outer layer. The middle layer can contain primarily softwood fibers. If desired, other fibers, such as high-yield fibers or synthetic fibers may be mixed with the softwood fibers in an amount up to about 10 percent by weight.

When constructing a web from a stratified fiber furnish, the relative weight of each layer can vary depending upon the particular application. For example, in one embodiment, when constructing a web containing three layers, each layer can be from about 15 to about 40 percent of the total weight of the web, such as from about 25 to about 35 percent of the total weight of the web.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™) Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ trade name.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same as those that supply the wet strength resins discussed above.

Another strength chemical that can be added to the furnish is Baystrength 3000 available from Kemira (Atlanta, Ga.), which is a glyoxalated cationic polyacrylamide used for imparting dry and temporary wet tensile strength to tissue webs.

As described above, the tissue product of the present disclosure can generally be formed by any of a variety of papermaking processes known in the art. In one embodiment the base web is formed by an uncreped through-air drying process. Referring to FIG. 1, a process for forming a tissue web for use in the present disclosure will be described in greater detail. The process shown depicts an uncreped through-dried process, but it will be recognized that any known papermaking method or tissue making method can be used in conjunction with the nonwoven tissue making fabrics of the present disclosure. Related uncreped through-air dried tissue processes are described for example, in U.S. Pat. Nos. 5,656,132 and 6,017,417, both of which are hereby incorporated by reference herein in a manner consistent with the present disclosure.

In FIG. 1, a twin wire former having a papermaking headbox 10 injects or deposits a furnish of an aqueous suspension of papermaking fibers onto a plurality of forming fabrics, such as the outer forming fabric 5 and the inner forming fabric 3, thereby forming a wet tissue web 6. The forming process of the present disclosure may be any conventional forming process known in the papermaking industry. Such formation processes include, but are not limited to, Fourdriniers, roof formers such as suction breast roll formers, and gap formers such as twin wire formers and crescent formers.

The wet tissue web 6 forms on the inner forming fabric 3 as the inner forming fabric 3 revolves about a forming roll 4. The inner forming fabric 3 serves to support and carry the newly-formed wet tissue web 6 downstream in the process as the wet tissue web 6 is partially dewatered to a consistency of about 10 percent based on the dry weight of the fibers. Additional dewatering of the wet tissue web 6 may be carried out by known paper making techniques, such as vacuum suction boxes, while the inner forming fabric 3 supports the wet tissue web 6. The wet tissue web 6 may be additionally dewatered to a consistency of at least about 20 percent, more specifically between about 20 to about 40 percent, and more specifically about 20 to about 30 percent.

The forming fabric 3 can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937, and Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

The wet web 6 is then transferred from the forming fabric 3 to a transfer fabric 8 while at a solids consistency of between about 10 to about 35 percent, and particularly, between about 20 to about 30 percent. As used herein, a "transfer fabric" is a fabric that is positioned between the forming section and the drying section of the web manufacturing process.

Preferably the transfer fabric has a three dimensional surface topography, which may be provided by substantially continuous machine direction ridges whereby the ridges are made up of multiple warp strands grouped together, such as those in U.S. Pat. No. 7,611,607, which is incorporated herein in a manner consistent with the present disclosure. Particularly preferred fabrics having a three dimensional surface topography that may be useful as transfer fabrics include fabrics described as Fred (t1207-77), Jetson (t1207-6) and Jack (t1207-12) in U.S. Pat. No. 7,611,607.

Transfer to the transfer fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies pressure at levels between about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

Typically, the transfer fabric 8 travels at a slower speed than the forming fabric 3 to enhance the MD and CD stretch of the web, which generally refers to the stretch of a web in its cross (CD) or machine direction (MD) (expressed as percent elongation at sample failure). For example, the relative speed difference between the two fabrics can be from about 10 to about 35 percent, in some embodiments from about 15 to about 30 percent, and in some embodiments, from about 20 to about 28 percent. This is commonly referred to as "rush transfer". During "rush transfer", many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following U.S. Pat. Nos. 5,667,636, 5,830,321, 4,440,597, 4,551,199, 4,849,054, all of which are hereby incorporated by reference herein in a manner consistent with the present disclosure.

The wet tissue web 6 is then transferred from the transfer fabric 8 to a throughdrying fabric 11. Typically, the transfer fabric 8 travels at approximately the same speed as the throughdrying fabric 11. However, it has now been discovered that a second rush transfer may be performed as the web is transferred from the transfer fabric 8 to a throughdrying fabric 11. This rush transfer is referred to herein as occurring at the second position and is achieved by operating the throughdrying fabric 11 at a slower speed than the transfer fabric 8. By performing rush transfer at two distinct locations, i.e., the first and the second positions, a tissue product having increased CD stretch may be produced.

In addition to rush transferring the wet tissue web from the transfer fabric 8 to the throughdrying fabric 11, the wet tissue web 6 may be macroscopically rearranged to conform to the surface of the throughdrying fabric 11 with the aid of a vacuum transfer roll 12 or a vacuum transfer shoe 9. If desired, the throughdrying fabric 11 can be run at a speed slower than the speed of the transfer fabric 8 to further enhance MD stretch of the resulting absorbent tissue product. The transfer may be carried out with vacuum assistance to ensure conformation of the wet tissue web 6 to the topography of the throughdrying fabric 11.

While supported by the throughdrying fabric 11, the wet tissue web 6 is dried to a final consistency of about 94 percent or greater by a throughdryer 13. The web 15 then passes through the winding nip between the reel drum 22 and the reel 26 and is wound into a roll of tissue 25 for subsequent converting, such as slitting cutting, folding, and packaging.

The web is transferred to the throughdrying fabric for final drying preferably with the assistance of vacuum to ensure macroscopic rearrangement of the web to give the desired bulk and appearance. Preferably the throughdrying fabrics are designed to deliver bulk and CD stretch to the tissue web. It is therefore useful to have throughdrying fabrics which are quite coarse and three dimensional in the optimized configuration. The result is that a relatively smooth sheet leaves the transfer section and then is macroscopically rearranged (with vacuum assist) to give the high bulk, high CD stretch surface topology of the throughdrying fabric. Sheet topology is completely changed from transfer to throughdrying fabric and fibers are macroscopically rearranged, including significant fiber to fiber movement.

Suitable throughdrying fabrics include, without limitation, fabrics with substantially continuous machine direction ridges whereby the ridges are made up of multiple warp strands grouped together, such as those disclosed in U.S. Pat. Nos. 6,998,024 and 7,611,607. Particularly preferred fabrics are those fabrics denoted as Fred (t1207-77), Jetson (t1207-6) and Jack (t1207-12) in U.S. Pat. No. 7,611,607. The web is preferably dried to final dryness on the throughdrying fabric, without being pressed against the surface of a Yankee dryer, and without subsequent creping.

Figure 2:
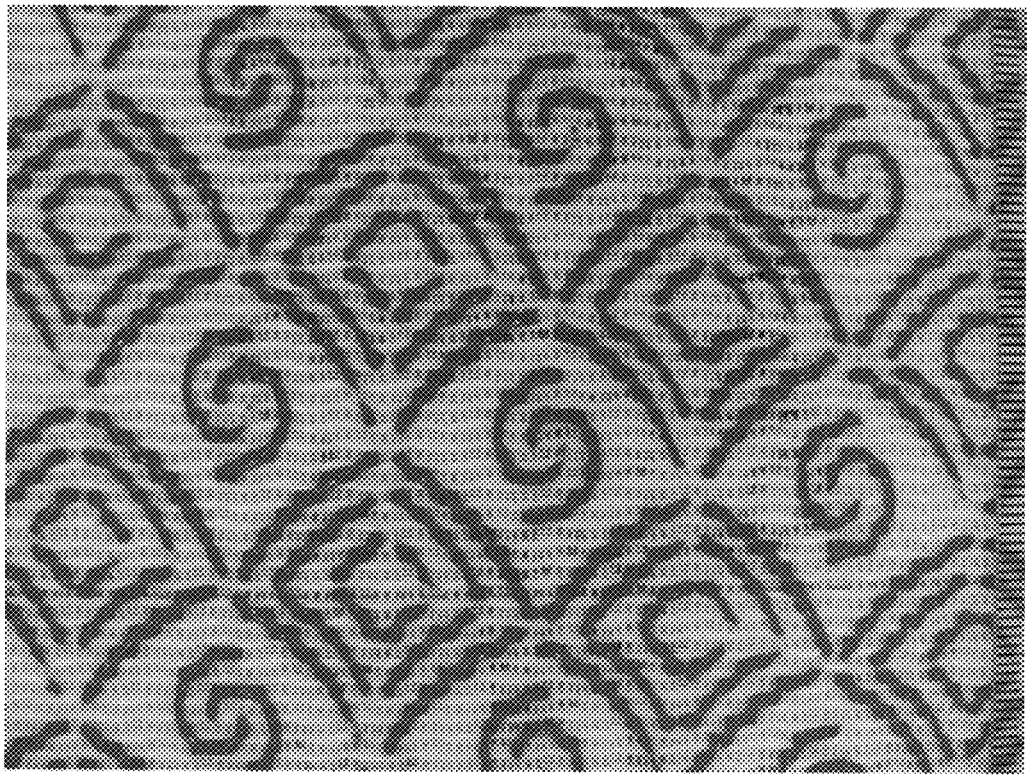
FIG. 2 is a photograph of a printed throughdrying fabric for use in the present disclosure.

More preferably, it is useful to use a throughdrying fabric having a design element disposed thereon such as the fabric illustrated in FIG. 2. In this manner, the design element (also referred to herein as the pattern) is impressed on the embryonic web during manufacture causing the design to be imparted thereon. Accordingly, in one embodiment, the webs are formed using a throughdrying fabric that has been modified by applying a decorative design element. The decorative design element may be a decorative figure, icon or shape such as a flower, heart, puppy, logo, trademark, word(s) and the like. The decorative design can be formed by raised areas (elements) which give the decorative design a topography that distinguishes it from the surrounding throughdrying fabric surface. These elements can suitably be one or more lines, segments, dots or other shapes.

Preferably the design elements are spaced about the web and can be equally spaced or may be varied such that the density and the spacing distance may be varied amongst the design elements. For example, the density of the design elements can be varied to provide a relatively large or relatively small number of design elements on the web. In a particularly preferred embodiment the design element density, measured as the percentage of background surface covered by a design element, is from about 10 to about 35 percent and more preferably from about 20 to about 30 percent. Similarly the spacing of the design elements can also be varied, for example, the design elements can be arranged in spaced apart rows. In addition, the distance between spaced apart rows and/or between the design elements within a single row can also be varied.

By disposing the design element on the throughdrying fabric, the resulting tissue web has a visibly recognizable design, imparted by the design element, and a textured background surface, imparted by the throughdrying fabric. Preferably the textured background surface has an overall background surface having a three-dimensional topography with z-directional elevation differences of about 0.2 millimeter or greater. The topography can be regular or irregular. The background surface is the overall predominant surface of the web, excluding any portions of the surface occupied by the decorative design elements. Suitable textured background surfaces include surfaces generally having alternating ridges and valleys or bumps and depressions. To distinguish from decorative designs, the frequency of alternating ridges and valleys in textured background patterns can be about 20 or greater per 10 centimeters. Similarly, the density of the bumps and depressions for textured background patterns can be about 0.6 or greater per square centimeter, more preferably 3 or greater per square centimeter.

Generally the design elements are topically applied to the throughdrying fabric. Particularly suitable methods of topical application are printing or extruding polymeric material onto the surface. Alternative methods include applying cast or cured films, weaving, embroidering or stitching polymeric fibers into the surface to create patterns or embossing. Particularly suitable polymeric materials include materials that can be strongly adhered to the throughdrying fabric and are resistant to thermal degradation at typical tissue machine dryer operating conditions and are reasonably flexible, such as silicones, polyesters, polyurethanes, epoxies, polyphenylsulfides and polyetherketones.

In another embodiment, such as that described in U.S. Pat. No. 6,398,910, which is incorporated herein in a manner consistent with the present discourse, the decorative design may be formed by extruding a polymeric strand onto a textured through-air drying fabric. The polymeric strand is applied so as to form a raised pattern above the plane of the texture through-air drying fabric.

It is believed that by forming a tissue web using a throughdrying fabric having a design element, as described above, that nesting may be reduced when the webs are converted into rolled product forms. Reduced nesting may, in-turn, improve certain properties, such as bulk and firmness, of the rolled product. Typically, nesting arises as a result of using textured throughdrying fabrics, which impart the tissue web with valleys and ridges. While these ridges and valleys can provide many benefits to the resulting web, problems sometimes arise when the web is converted into final product forms. For example, when webs are converted to rolled products, the ridges and valleys of one winding are placed on top of corresponding ridges and valleys of the next winding, which causes the roll to become more tightly packed, thereby reducing roll bulk, increasing density and making the winding of the product less consistent and controllable. Thus, in certain embodiments the present disclosure provides tissue products comprising a tissue web having a textured background surface and a design element, wherein the design elements reduces nesting of the web when it is converted into a rolled product. The resulting rolls generally have higher roll bulk at a given roll firmness. Further, the rolls generally have a surprising degree of interlocking between successive wraps of the spirally wound web, improving roll structure at a given roll firmness, more specifically allowing less firm rolls to be made without slippage between wraps.

Improving interlocking between successive wraps allows less firm rolls to be made without slippage between wraps. For example, compared to tissue products produced using a throughdryer fabric with an offset seam, such as those disclosed in U.S. Pat. No. 7,611,605, the contents of which are incorporated herein in a manner consistent with the present disclosure, rolled tissue products of the present disclosure have similarly improved roll structure and reduced nesting. One measure of the reduced nesting and improved roll structure, referred to herein as Roll Structure, is the quotient of roll bulk (expressed in cc/g) divided by Roll Firmness (expressed in cm), divided by single sheet caliper (express in cm). Generally rolled tissue products have a Roll Structure less than about 500 cm/g and more preferably less than about 450 cm/g and still more preferably less than about 350 cm/g, such as from about 200 to about 500 cm/g and more preferably from about 250 to about 450 cm/g.

Figure 3:
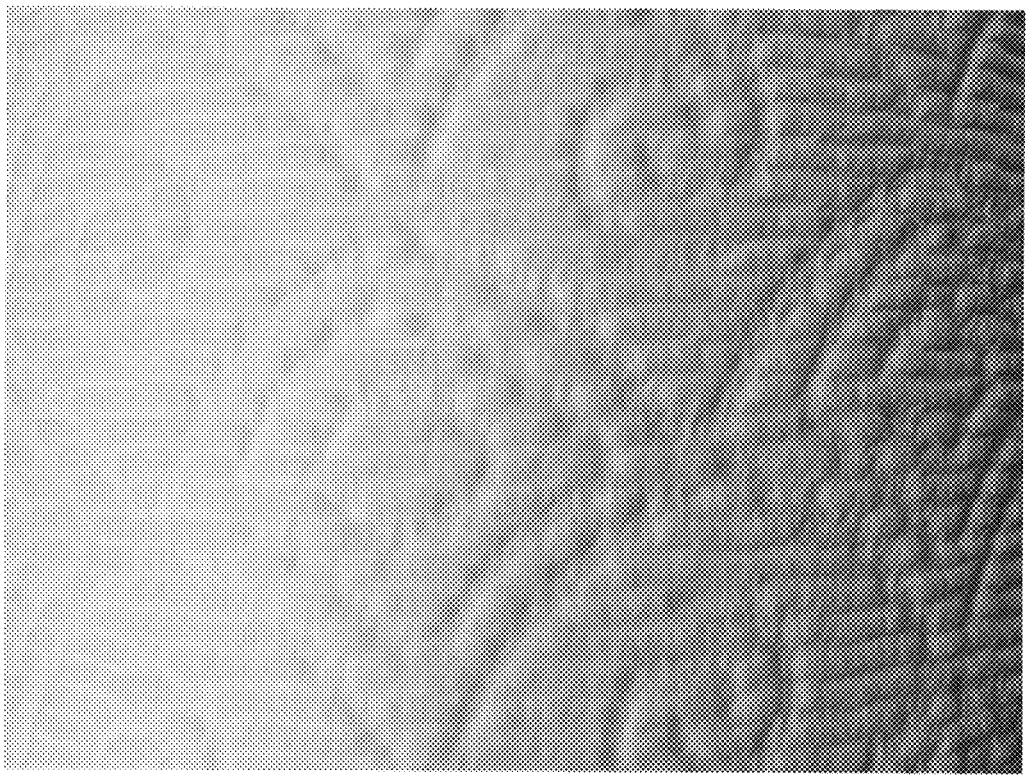
FIG. 3 is a photograph of a through-air dried tissue web having a pattern produced according to one embodiment of the present disclosure.

Further, it is believed that the use of printed throughdrying fabrics results in webs having improved pattern clarity. One embodiment of a web having improved image clarity is illustrated in FIG. 3. Surprisingly, by disposing a pattern on a textured background the visual contrast between pattern and background is improved, resulting in a clearer, sharper pattern. Also, the textured background allows for the use of relatively soft or fragile print materials.

The pattern clarity is improved to a degree that is recognizable to a consumer when the product is displayed on shelf. In this manner the consumer may provide a qualitative evaluation of how well-defined the pattern is. The consumer may evaluate clarity on a scale of zero to ten, such that a clarity rating of zero indicates that there is no discernible pattern and a clarity rating of ten is a well-defined pattern with crisp edges, defined height and depth to the pattern, and appears to be a perfect impression copy of the design pattern. Prior to the inventive method discussed above, material made by the previously used process had a qualitative pattern clarity rating of about five. Now, by using the inventive method described above, the inventors were able to produce webs having a visible, well-defined pattern, such that consumers provide a qualitative rating greater than about eight.

Not only is image clarity improved by disposing a pattern on a highly textured throughdrying fabric, but the clarity of that image throughout the course of manufacture is also improved. That is, the clarity of the image on the resulting web is not significantly diminished from the beginning to the end of the life of the throughdrying fabric. Previously, patterns were disposed on relatively flat throughdrying fabrics and the printed pattern would become worn from the throughdrying fabric, resulting in deteriorating image quality over the course of the life of the fabric. Now, by disposing the pattern on a textured background surface, any wear of the pattern is effectively halted once the pattern is worn down to the top surface of the background texture, allowing for excellent pattern clarity throughout the usable life of the throughdrying fabric.

Once the web is transferred to the throughdrying fabric, it may be dried using any noncompressive drying method which tends to preserve the bulk or thickness of the wet web including, without limitation, throughdrying, infra-red radiation, microwave drying, etc. Because of its commercial availability and practicality, throughdrying is well known and is one commonly used means for noncompressively drying the web for purposes of this invention.

After the web is formed and dried, the tissue product of the present invention undergoes a converting process where the formed base web is wound into a roll for final packaging. Prior to or during this converting process, in accordance with the present disclosure, the base web of the tissue product is subjected to a calendering process in order to reduce sheet caliper and improve softness while maintaining sufficient tensile strength. The calendering process compresses the web, effectively breaking some bonds formed between the fibers of the base web. In this manner, calendering may increase the perceived softness of the tissue product. In some applications, the bulk of the tissue web can be largely maintained. At the very least, through this process, a greater amount of bulk remains in the sheet after the sheet is wound. This higher sheet bulk is manifested as higher product roll bulk at a fixed firmness while maintaining the required sheet softness.

The following examples are intended to illustrate particular embodiments of the present disclosure without limiting the scope of the appended claims.

EXAMPLES

Example 1

Basesheets were made using a throughdried papermaking process commonly referred to as "uncreped through-air dried" ("UCTAD") as generally described in U.S. Pat. No. 5,607,551. Basesheets with a target bone dry basis weight ranging from about 26 to about 34 grams per square meter (gsm) were produced. The basesheets were then converted and spirally wound into rolled tissue products.

In all cases the basesheets were produced from a furnish comprising northern softwood kraft and eucalyptus kraft using a layered headbox fed by three stock chests such that the webs having three layers (two outer layers and a middle layer) were formed. The two outer layers comprised eucalyptus (each layer comprising 30 percent weight by total weight of the web) and the middle layer comprised softwood and eucalyptus. The amount of softwood and eucalyptus kraft in the middle layer varied for the control and inventive samples. For controls the middle layered comprised 29 percent by total weight of the web softwood and 11 percent by weight of the web eucalyptus. For inventive samples the middle layer comprised 25 percent by weight of the web softwood and 15 percent by weight of the web eucalyptus. Strength was controlled via the addition of starch and/or by refining the furnish.

The tissue web was formed on a TissueForm V forming fabric, vacuum dewatered to approximately 25 percent consistency and then subjected to rush transfer when transferred to the transfer fabric. The transfer fabric was the fabric described as "Fred" in U.S. Pat. No. 7,611,607 (commercially available from Voith Fabrics, Appleton, Wis.).

The web was then transferred to a second "Fred" fabric, which was used for throughdrying. The second "Fred" fabric included a graphic printed on the web using silicone as illustrated in FIG. 3. Transfer to the throughdrying fabric was done using vacuum levels of at least about 10 inches of mercury at the transfer. The web was then dried to approximately 98 percent solids before winding.

Control codes were produced as described above, but using a relatively flat troughdrying fabric, referred to as 44MST in U.S. Pat. No. 7,611,607 (commercially available from Voith Fabrics, Appleton, Wis.). Table 2 shows the process conditions for each of the samples prepared in accordance with the present example.

TABLE 2

| Sample No. | Basis Weight (gsm) | Refining (hpt/day) | Starch (lbs/MT) | Rush Transfer (%) |
|---|---|---|---|---|
| 1 (Control) | 32.7 | — | 4 | 24 |
| 2 (Inventive) | 33.4 | 2.6 | 2.4 | 28 |
| 3 (Inventive) | 28.8 | 2 | 2 | 28 |
| 4 (Inventive) | 33.0 | 2 | 1.8 | 28 |
| 5 (Inventive) | 36.8 | 2 | 1.8 | 28 |
| 6 (Inventive) | 33.4 | 2.6 | 2.4 | 28 |
| 7 (Inventive) | 30.5 | — | 4 | 28 |
| 8 (Inventive) | 33.4 | — | 4 | 28 |

Tables 3 and 4 summarize the physical properties of the basesheet webs.

TABLE 3

| Sample No. | BW (gsm) | Caliper (mils) | Sheet Bulk (cc/g) | GMT (g/3") | MD Slope (g/3") | CD Slope (g/3") | CDS (%) |
|---|---|---|---|---|---|---|---|
| 1 (control) | 32.7 | 27.1 | 21.1 | 1114 | 8183 | 9673 | 9.1 |
| 2 (Inventive) | 33.4 | 41.5 | 31.6 | 1069 | 5152 | 6346 | 10.1 |
| 3 (Inventive) | 28.8 | 39.2 | 34.6 | 886 | 4074 | 4226 | 12.7 |
| 4 (Inventive) | 33.0 | 40.7 | 31.3 | 1081 | 4960 | 5417 | 12.0 |
| 5 (Inventive) | 36.8 | 44.0 | 30.4 | 1262 | 5549 | 6710 | 11.2 |
| 6 (Inventive) | 33.4 | 41.5 | 31.6 | 1071 | 5160 | 6405 | 9.9 |
| 7 (Inventive) | 30.5 | 38.6 | 32.1 | 1069 | 4906 | 5503 | 11.7 |
| 8 (Inventive) | 33.4 | 40.7 | 31.0 | 1062 | 5474 | 5731 | 11.5 |

TABLE 4

| Sample No. | GM Slope (g/3") | Stiffness Index | Delta Stiffness Index | Delta Bulk |
|---|---|---|---|---|
| 1 (control) | 8897 | 7.99 | — | — |
| 2 (Inventive) | 5718 | 5.38 | −33% | 49.8% |
| 3 (Inventive) | 4149 | 4.68 | −41% | 64.0% |
| 4 (Inventive) | 5183 | 4.79 | −40% | 48.3% |
| 5 (Inventive) | 6102 | 4.83 | −39% | 44.1% |
| 6 (Inventive) | 5749 | 5.37 | −33% | 49.8% |

TABLE 4-continued

| Sample No. | GM Slope (g/3") | Stiffness Index | Delta Stiffness Index | Delta Bulk |
|---|---|---|---|---|
| 7 (Inventive) | 5196 | 4.86 | −39% | 52.1% |
| 8 (Inventive) | 5601 | 5.27 | −34% | 46.9% |

The basesheet webs were converted into various bath tissue rolls. Specifically, basesheet was calendered using one or two conventional polyurethane/steel calenders comprising either a 4 or a 40 P&J polyurethane roll on the air side of the sheet and a standard steel roll on the fabric side. Process conditions for each sample are provided in Table 5, below. All rolled products comprised a single ply of basesheet, such that rolled product sample Roll 1 comprised a single ply of basesheet sample 1, Roll 2 comprised a single ply of basesheet sample 2, and so forth. Calendering produced webs having a caliper from about 19 to about 22 mils and sheet bulks from about 16 to about 19.0 cc/g.

TABLE 5

| Sample No. | 4 P&J Calender Load (pli) | 40 P&J Calender Load (pli) | Roll Diameter (mm) | Sheet Caliper (mils) | Sheet Bulk (cc/g) |
|---|---|---|---|---|---|
| Roll 1 | — | 160 | 120 | 15.5 | 12.9 |
| Roll 2 | — | 100 | 126 | 20.1 | 16.6 |
| Roll 3 | — | 100 | 126 | 19.8 | 18.8 |
| Roll 4 | — | 100 | 126 | 21.8 | 18.6 |
| Roll 5 | 30 | 100 | 126 | 21.7 | 16.4 |

Table 6, below, shows the physical properties of rolled tissue products produced from the basesheet webs described above.

TABLE 6

| Sample No. | BW (gsm) | Roll Bulk (cc/g) | Roll Firmness (mm) | GMT (g/3") | MD Slope (g/3") | CD Slope (g/3") | CDS (%) | GM Slope (g/3") | Stiffness Index |
|---|---|---|---|---|---|---|---|---|---|
| Roll 1 | 30.6 | 9.6 | 4.7 | 858 | 9000 | 7500 | 8.4 | 8215 | 9.57 |
| Roll 2 | 30.8 | 13.1 | 9.1 | 834 | 6800 | 5600 | 9.0 | 6171 | 7.40 |
| Roll 3 | 26.7 | 13.5 | 9.5 | 646 | 6000 | 3900 | 10.2 | 4837 | 7.49 |
| Roll 4 | 29.8 | 13.1 | 9.0 | 742 | 6000 | 4800 | 9.8 | 5367 | 7.20 |
| Roll 5 | 33.7 | 13.0 | 10.2 | 899 | 6400 | 5900 | 9.4 | 6145 | 6.83 |

Example 2

Basesheets were made using the UCTAD process substantially as described above. Basesheets with a target bone dry basis weight of about 32 grams per square meter (gsm) and a GMT of about 1000 g/3" were produced. The basesheets were then converted and spirally wound into rolled tissue products. Table 7 shows the process conditions for each of the samples prepared in accordance with the present example.

TABLE 7

| Sample No. | Basis Weight (gsm) | Refining (hpt/day) | Starch (lbs/MT) | Rush Transfer (%) |
|---|---|---|---|---|
| 9 (Control) | 30.8 | 2.0 | 8.0 | 24 |
| 10 (Inventive) | 28.1 | 2.0 | 11.0 | 28 |

TABLE 7-continued

| Sample No. | Basis Weight (gsm) | Refining (hpt/day) | Starch (lbs/MT) | Rush Transfer (%) |
|---|---|---|---|---|
| 11 (Inventive) | 30.8 | — | — | 24 |
| 12 (Inventive) | 28.4 | — | — | 24 |

Tables 8 and 9 summarize the physical properties of the basesheet webs.

TABLE 8

| Sample No. | Basis Weight (gsm) | Caliper (mils) | Sheet Bulk (cc/g) | GMT (g/3") | MD Slope (g/3") | CD Slope (g/3") | CD Stretch (%) |
|---|---|---|---|---|---|---|---|
| 9 (Control) | 30.8 | 14.2 | 11.7 | 736 | 9640 | 3180 | 14.7 |
| 10 (Invention) | 28.1 | 20.1 | 18.2 | 757 | 5650 | 2800 | 13.9 |
| 11 (Invention) | 30.8 | 20.0 | 16.5 | 755 | 9550 | 2870 | 14.4 |
| 12 (Invention) | 28.4 | 20.4 | 18.2 | 740 | 5353 | 3320 | 11.8 |

TABLE 9

| Sample No. | GM Slope (g/3") | Stiffness Index | Delta Stiffness Index | Delta Sheet Bulk |
|---|---|---|---|---|
| 9 (Control) | 5536.7 | 7.52 | — | — |
| 10 (Invention) | 3977.4 | 5.25 | −30% | 55% |
| 11 (Invention) | 5235.3 | 6.94 | −8% | 41% |
| 12 (Invention) | 4215.7 | 5.70 | −24% | 56% |

The basesheet webs were converted into various bath tissue rolls. Specifically, basesheet was calendered using one or two conventional polyurethane/steel calenders comprising either a 15 or a 40 P&J polyurethane roll on the air side of the sheet and a standard steel roll on the fabric side. Process conditions for each sample are provided in Table 10, below. All rolled products comprised a single ply of basesheet, such that rolled product sample Roll 9 comprised a single ply of basesheet sample 9, Roll 10 comprised a single ply of basesheet sample 10, and so forth.

TABLE 10

| Sample No. | 15 P&J Calender Load (pli) | 40 P&J Calender Load (pli) | Roll Diameter (mm) | Sheet Caliper (mils) | Sheet Bulk (cc/g) |
|---|---|---|---|---|---|
| Roll 9 | 95 | — | 116.5 | 14.2 | 11.7 |
| Roll 10 | — | 100 | 124.0 | 20.1 | 18.2 |
| Roll 11 | — | 52 | 123.0 | 20.0 | 16.5 |
| Roll 12 | — | 100 | 124.0 | 20.4 | 18.2 |

Table 11, below, shows the physical properties of rolled tissue products produced from the basesheet webs described above.

TABLE 11

| Sample No. | Basis Weight (gsm) | Roll Bulk (cc/g) | Roll Firmness (mm) | GMT (g/3") | MD Slope (g/3") | CD Slope (g/3") | CD Stretch (%) | GM Slope (g/3") | Stiffness Index |
|---|---|---|---|---|---|---|---|---|---|
| Roll 9 | 30.8 | 9.6 | 4.6 | 736 | 9640 | 3180 | 14.7 | 5536.7 | 7.52 |
| Roll 10 | 28.1 | 14.1 | 6.2 | 757 | 5650 | 2800 | 13.9 | 3977.4 | 5.25 |
| Roll 11 | 30.8 | 12.6 | 7.1 | 755 | 9550 | 2870 | 14.4 | 5235.3 | 6.94 |
| Roll 12 | 28.4 | 13.9 | 8.2 | 740 | 5353 | 3320 | 11.8 | 4215.7 | 5.70 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present disclosure should be assessed as that of the appended claims and any equivalents thereto.

We claim:

1. A rolled tissue product comprising a single ply tissue web spirally wound into a roll, the single ply web having a sheet bulk greater than about 15.0 cc/g and the roll having a Roll Structure from about 200 to about 500 cm/g.

2. The tissue product of claim 1, wherein the single ply tissue web comprises a through-air dried web.

3. The tissue product of claim 2, wherein the through-air dried web is uncreped.

4. The tissue product of claim 1, wherein the wound roll has a Roll Bulk from about 12 to about 18 cc/g.

5. The tissue product of claim 1, wherein the single ply web has a geometric mean tensile (GMT) from about 650 to about 1000 g/3".

6. The tissue product of claim 1, wherein the single ply web has a Stiffness Index from about 4.5 to about 8.

7. The tissue product of claim 1, wherein the single ply web has a geometric mean slope from about 4,000 to about 6,500 g/3".

8. The tissue product of claim 1, wherein the single ply web has a percent CD stretch from about 10 to about 15 percent.

9. The tissue product of claim 1, wherein the roll has a Roll Structure from about 250 to about 450 cm/g.

10. The tissue product of claim 1, wherein the sheet bulk is from about 15.0 to about 20.0 cc/g.

11. The tissue product of claim 1 having a bone dry basis weight from about 28 to about 32 gsm.

12. The tissue product of claim 1, wherein the roll has a Roll Firmness from about 5 to about 10 mm.

* * * * *